US005634638A

United States Patent [19]

Havens et al.

[11] Patent Number: 5,634,638

[45] Date of Patent: Jun. 3, 1997

[54] PORTABLE, RETRACTABLE SPORTS ENCLOSURE

[75] Inventors: Ronald W. Havens; Johannus J. DeGroot, both of Campbell; William J. McMillan, San Jose, all of Calif.

[73] Assignee: RJB Sports Equipment, Inc., Campbell, Calif.

[21] Appl. No.: 498,746

[22] Filed: Jul. 6, 1995

[51] Int. Cl.[6] ..... A63B 69/40

[52] U.S. Cl. ..... 473/421; 135/128

[58] Field of Search ..... 273/26 A, 29 R, 273/410, 411, 26 D; 135/128, 143, 144, 157

[56] References Cited

U.S. PATENT DOCUMENTS

| | | | |
|---|---|---|---|
| 3,472,252 | 10/1969 | Siebring | 135/128 |
| 3,541,626 | 11/1970 | Eggert, Jr. | 135/128 |
| 3,644,952 | 2/1972 | Hatch | 135/128 |
| 3,929,145 | 12/1975 | Schroeder | 135/128 |
| 4,120,067 | 10/1978 | Hone et al. | 135/128 |
| 4,815,736 | 3/1989 | Wright | 273/26 A |
| 5,056,782 | 10/1991 | Giovagnoli | 273/26 D |
| 5,335,684 | 8/1994 | Hanninen | 135/128 |

*Primary Examiner*—Theatrice Brown

*Attorney, Agent, or Firm*—Daniel J. Bourque; Kevin J. Carroll

[57] ABSTRACT

A portable self-standing sports enclosure which may be opened and closed by a single person. A carrier frame contains at least one foldable frame section. Each foldable frame section includes an enclosure support member. The foldable frame sections fold into and are locked to a carrier frame for transportation. The foldable frame sections may be hinged to allow the frame to fold to half their normal height. An optional carrier frame with wheels allows easy transportation. Netting proximate the frame members completely encloses the sports activities inside.

20 Claims, 10 Drawing Sheets

PORTABLE, RETRACTABLE SPORTS ENCLOSURE

FIELD OF THE INVENTION

This invention relates to a mobile structure and more particularly, to a portable, and easily retractable self-standing sports enclosure.

BACKGROUND OF THE INVENTION

In practicing for various sports using balls such as baseball, softball, golf, or the like, it is common to have a cage or enclosure to contain the balls to prevent danger to other persons, damage to property or lost balls during practice sessions. Such enclosures must be large enough to allow a person or persons to practice, yet preferably be portable enough to allow the structure to be easily and quickly moved from one place to another. Further, an easily expandable and collapsible enclosure that may be used inside a building as well as outside would have greater utility.

In the past, there have been many efforts to provide portable sporting cages. For example, U.S. Pat. No. 4,815,736 issued to Wright discloses a portable batting cage and method of assembling same. This cage requires several support arcs 14 to be raised separately, which are then held in place with stakes in the ground or special boots for use inside a building. The support arcs are held upright with tie lines 66, 68 which also must be staked down. Once the frame is in place, a netting must be placed over it. Assembling such a cage requires the time and effort of several people. Once the cage is in place, it cannot be moved or temporarily stored away without complete disassembly.

U.S. Pat. No. 5,370,385 issued to Joy discloses a portable batting cage. The cage can be assembled at a practice site, and includes wheels for moving the cage wherever needed. Once assembled, however, the cage is too large to be easily moved, even though it is mounted on wheels. Moving the structure would require disassembly which takes time. Also, the cage is not large enough to contain more than one person batting at a time. Most importantly, the cage does not fully enclose the participant.

U.S. Pat. No. 5,178,384 issued to Gorman, discloses a collapsible sports practice device. This device is portable, but requires a rigid structure such as a backstop or gym wall for support. Therefore, it is limited as to where it may be used. This device also does not fully enclose the participant.

Accordingly, what is needed is a portable, self-standing, generally fully enclosed sporting enclosure which requires minimal effort to install and remove, is large and long enough to be used for practice in games such as baseball, and may be used inside or outside of a building.

SUMMARY OF THE INVENTION

This invention features a portable, self-standing sports enclosure which can be extended open and retracted closed by a single person. When opened, the sports enclosure provides a large enclosed area for sports practice and games. When closed, it can be easily transported by a single person or towed by a vehicle. The sports enclosure includes at least one foldable frame section. This foldable frame section may be free standing or connected to one end of a carrier frame. Each foldable frame section can be free standing.

The foldable frame section includes at least one enclosure support member for supporting netting. Connected to a first end region of the enclosure support member is a first enclosure support member interconnection member. The first enclosure support member interconnection member is pivotably connected proximate its second and to a first end of a second enclosure support member interconnection member. The second end of the second enclosure support member interconnection member is pivotably connected to the carrier frame.

Connected to a second end region of the enclosure support member is a first end of a third enclosure support member interconnection member, with the second end of the third enclosure support member pivotably connected to a first end of a fourth enclosure support member interconnection member. The second end of the fourth enclosure support member interconnection member is also pivotably connected to the carrier frame.

The foldable frame section also includes at least two enclosure support member stabilizers. A first end of the first enclosure support member stabilizer is slidably engaged to a first side of the enclosure support member, while the second end is pivotably connected to the first enclosure support member interconnection member at a point between the first and second ends of the first enclosure support member interconnection member.

The second enclosure support member stabilizer is similarly slidably engaged to the second side of the enclosure support member, with the second end of the second enclosure support member stabilizer pivotably connected to the third enclosure support member interconnection member at a point between the first and second ends of the third enclosure support member interconnection member.

Several foldable frame sections may be interconnected together to produce as large a portable sports enclosure as needed. The second and fourth enclosure support member interconnection members of a next foldable frame section are pivotably connected to the first and second end regions of an enclosure support member of a previous foldable frame section. A carrier frame is preferably provided. The carrier frame also has an enclosure support member rigidly attached to it, with the first foldable frame section connected to the carrier frame enclosure support member.

The carrier frame typically includes wheels to facilitate transporting the sports enclosure as well as opening and closing. In the closed position, locking mechanisms on the carrier frame secure each side of the enclosure support member for each foldable frame section. When closed, the foldable frame sections are all completely retracted inside the frame of the carrier frame. In one embodiment, the foldable frame sections vary in width to allow each section to be stored within a previous, wider, section, forming concentric sections.

The foldable frame sections may also include hinged enclosure support members to allow the enclosure support members to be reduced in height. The enclosure support members are typically inverted "U" or "V" in shape. The carrier frame may also include a platform for supporting any device for use in the sport being practiced, such as a pitching machine or target. The carrier frame may also include a trailer hitch, storage cabinets, lights and steering mechanisms.

An enclosing fabric, such as nylon netting, is connected to or placed over the enclosure support members to enclose the sports enclosure.

DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

Figure 1:
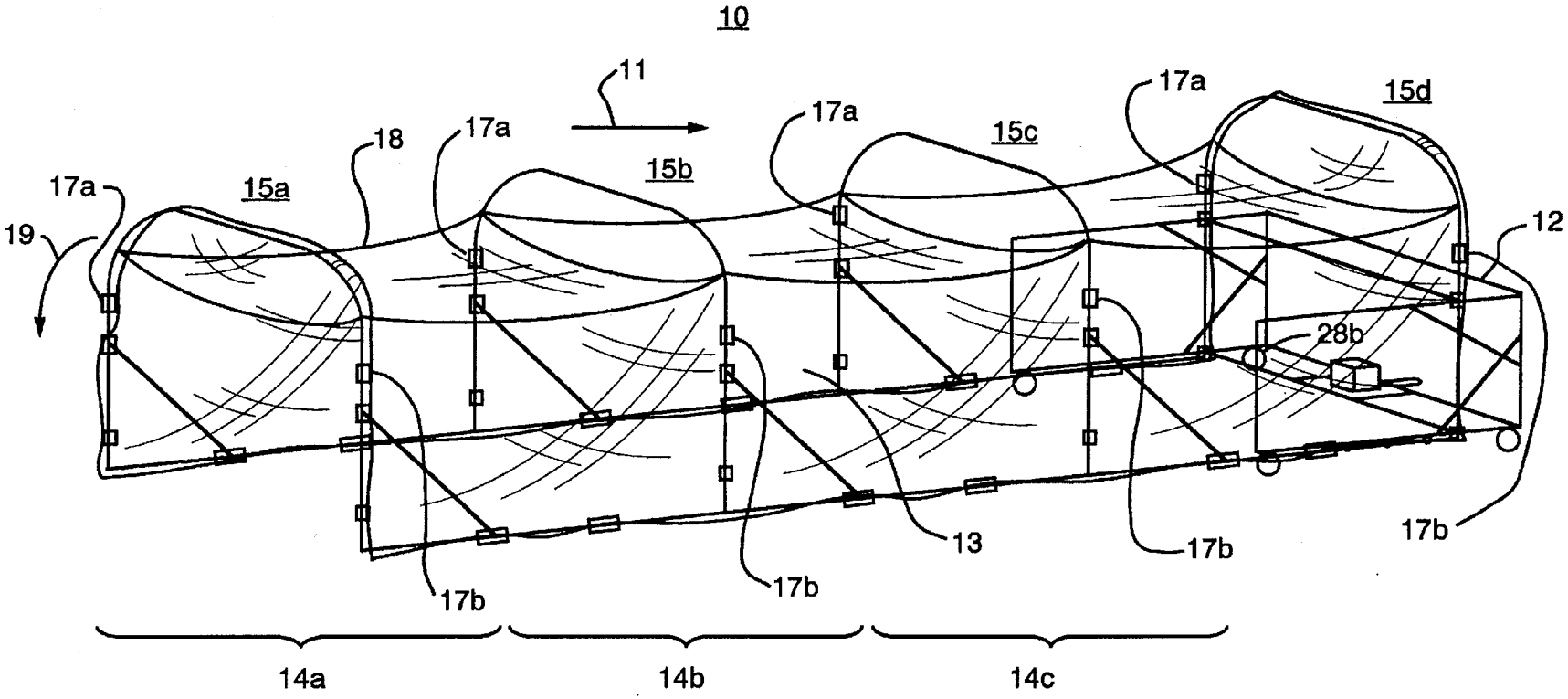
FIG. 1 is a side perspective view of the portable sports enclosure according to the present invention, fully expanded and with netting in place.

A portable retractable sports enclosure 10, FIG. 1 according to the present invention is shown in an open position. Enclosure support members or frame arches 15*a*–15*d* provide support for a net element 18 to enclose a playing or practice area 13.

The sports enclosure 10 consists of one or more foldable frame sections 14, a carrier frame 12 and, in one embodiment, a final enclosure support member 15*d* secured to the carrier frame 12. The portable retractable sports enclosure 10 may be used on any surface including a playing field or back yard, and the floor of a gymnasium or any other structure.

The sports enclosure 10 is generally opened by unfolding at least one foldable frame section 14 and subsequently moving carrier frame carrier 12 in a direction generally shown by arrow 11, while extending or unfolding each foldable frame section 14, as will be discussed below.

Typically, enclosure support members 15 measure approximately 12 feet wide by 12 feet tall. In order to allow the sports enclosure 10 to be wheeled through a standard 6 foot high doorway, each enclosure support member 15 may be hinged as shown generally by hinges 17*a* and 17*b* allowing the enclosure support members 15 to be folded generally in half as shown by arrow 19 to a size of approximately 6 feet high by 12 feet long.

Figure 2:
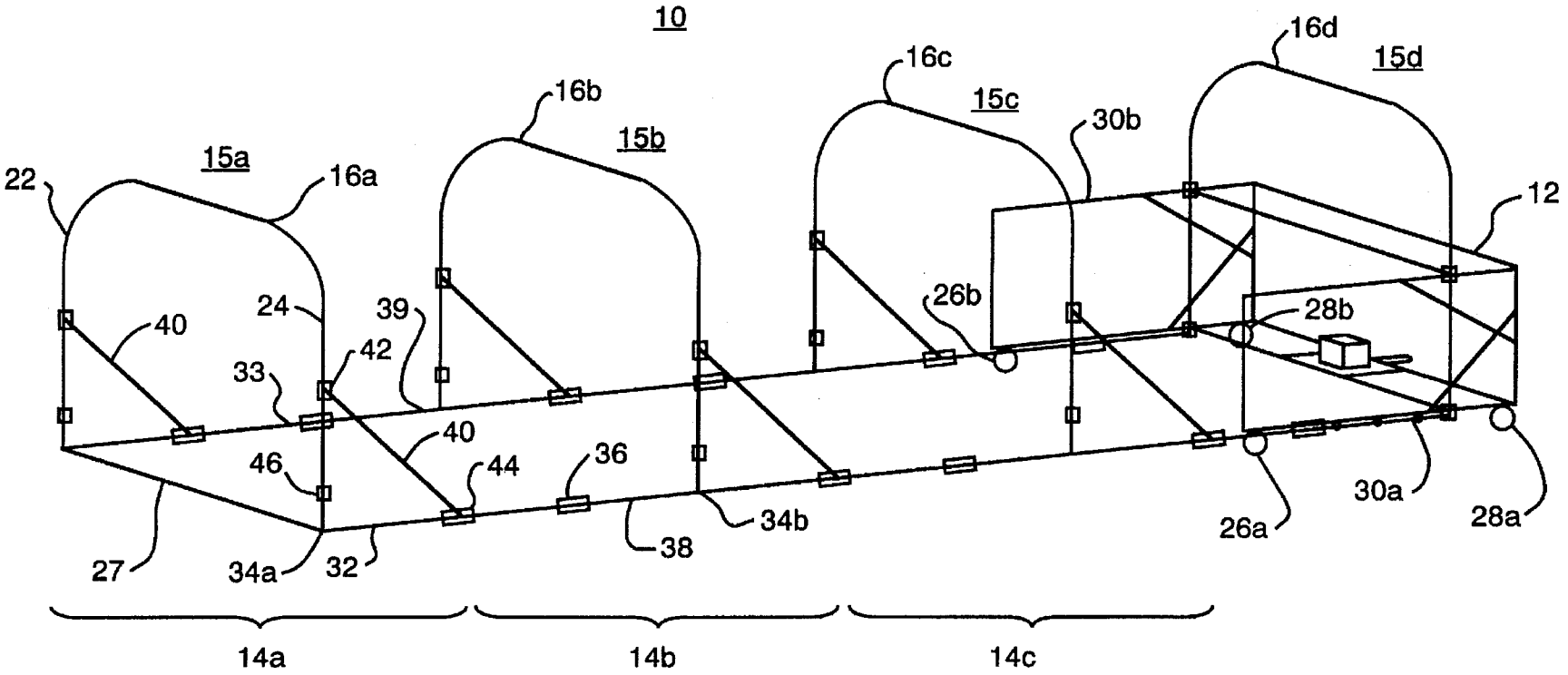
FIG. 2 is a side perspective view of the portable sports enclosure in an open position without netting.

Each enclosure support member 15, FIG. 2 typically comprises an inverted "U" shape with a horizontal top bar 16, a left side 22 and a right side 24, with rounded elbow joints. Each enclosure support member 15 is preferably constructed of welded or extruded tubular steel with a diameter of 1½" of 1/16" gauge walls. Any structural material supplying durable strength and lightness, however may be employed including for example, other metals, composites, fiberglass, wood or plastic. In the preferred embodiment, the last enclosure support member or frame arch 15*d* is permanently mounted or coupled to carrier frame 12, if used with the carrier.

In the first foldable frame section 14*a*, the right side 24 of enclosure support member 15*a* includes a first end region which is connected by a hinge 34*a* or other similar pivotable member to a first end of a first enclosure support member interconnection member 32. First enclosure support member interconnection member 32 is also connected at its second end by pivotable hinge 36 to a first end of a second interconnection member 38. The second end of a second enclosure support member interconnection member 38 is connected to hinge 34*b* of the next adjacent foldable frame section 14*b*. In the preferred embodiment, enclosure support member interconnection members 32, 38 are 5 feet long.

An enclosure support member stabilizer 40 is connected to a sliding engaging member 42, which allows enclosure support member stabilizer 40 to pivot about hinge 44 while sliding engaging member 42 slides along right side 24 of the first enclosure support member 15a. In the preferred embodiment, sliding engaging member 42 is a "ring" type of device surrounding side 24 with a tab to which enclosure support member stabilizer 40 is pivotably attached. The second end of enclosure support member stabilizer 40 is connected by pivotable hinge 44 to a region generally midpoint of first interconnection member 32.

The left side 22 of first foldable frame section 14*a* is a mirror image of right side 24, using corresponding components for the third and fourth interconnection members 33, 39, and enclosure support member stabilizers 40.

Any number of foldable frame sections 14 may be used for the portable sports enclosure 10. In the preferred embodiment, three foldable frame sections 14*a*–*c* are employed, however this number may be increased or decreased depending upon the preference of the manufacturer or the ultimate use of the sports enclosure 10. The outermost foldable frame section 14*a* may include a bottom horizontal stabilizing bar 27 to provide extra rigidity. No other foldable frame sections 14*b*–*c* require this, as it will interfere with the playing area inside sports enclosure 10. Additional foldable frame sections 14 can be added by connecting the second and fourth interconnection members 38, 39 to a hinge member 34 of a preceding section, as generally shown by 38', FIG. 3A.

Figure 3A:
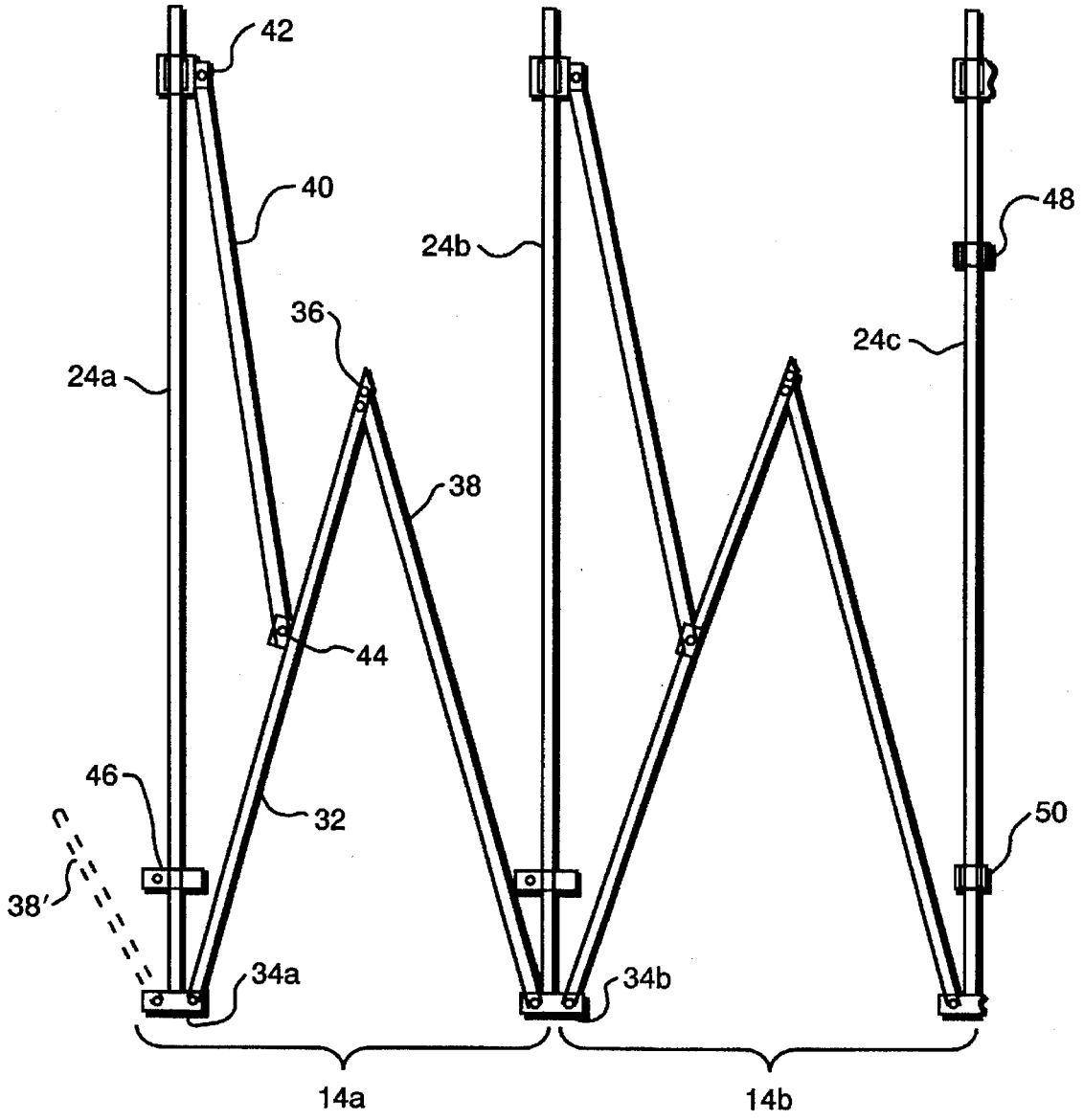
FIG. 3A is a side view of an foldable frame section in closed position.

In the folded or retracted position, foldable frame sections 14 FIG. 3A, occupy little horizontal space. Side 24 and corresponding side 22 (not shown) of enclosure support member 15 remain generally vertical, however, which maintains the netting enclosure (not shown) from contacting the ground.

Figure 3B:
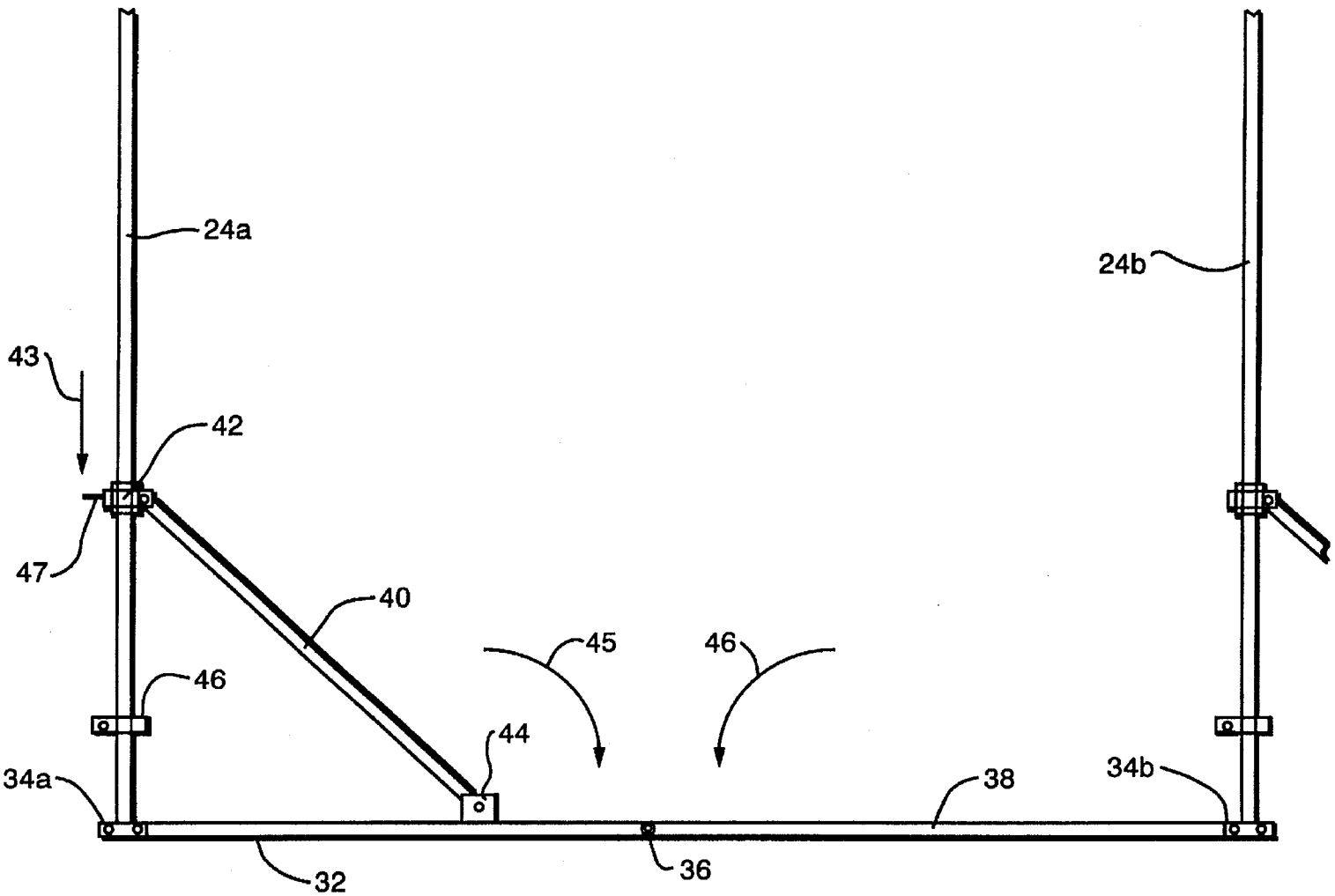
FIG. 3B is a side view of the foldable frame section in open position.

In the extended or open position, FIG. 3B, first interconnection member 32 has pivoted downwardly as shown by arrow 45 while second interconnection member 38 has pivoted downwardly as shown by arrow 46, such that both interconnection members reach a horizontal position and lie flat on the ground or floor. During extension, sliding engaging member 42 slides down side 24*a*, to a position where enclosure support member stabilizer 40 provides upright support to side 24*a*. Sliding engaging member 42 is then locked in position on side bar 24*a* with a device such as a bolt 47.

In the open position, bar 24*a* is securely and rigidly positioned by hinge 34 and enclosure support member stabilizer 40. No other supports such as stakes, floor grips or standing structures are needed to allow the portable retractable sports enclosure to be used in the open position. The last enclosure 8 support member or frame arch 15*d* is preferably but not necessarily securely connected to the carrier frame 12 by connectors 48 and 50, FIG. 3A, and is thereby fully supported by carrier frame 12.

Figure 4:
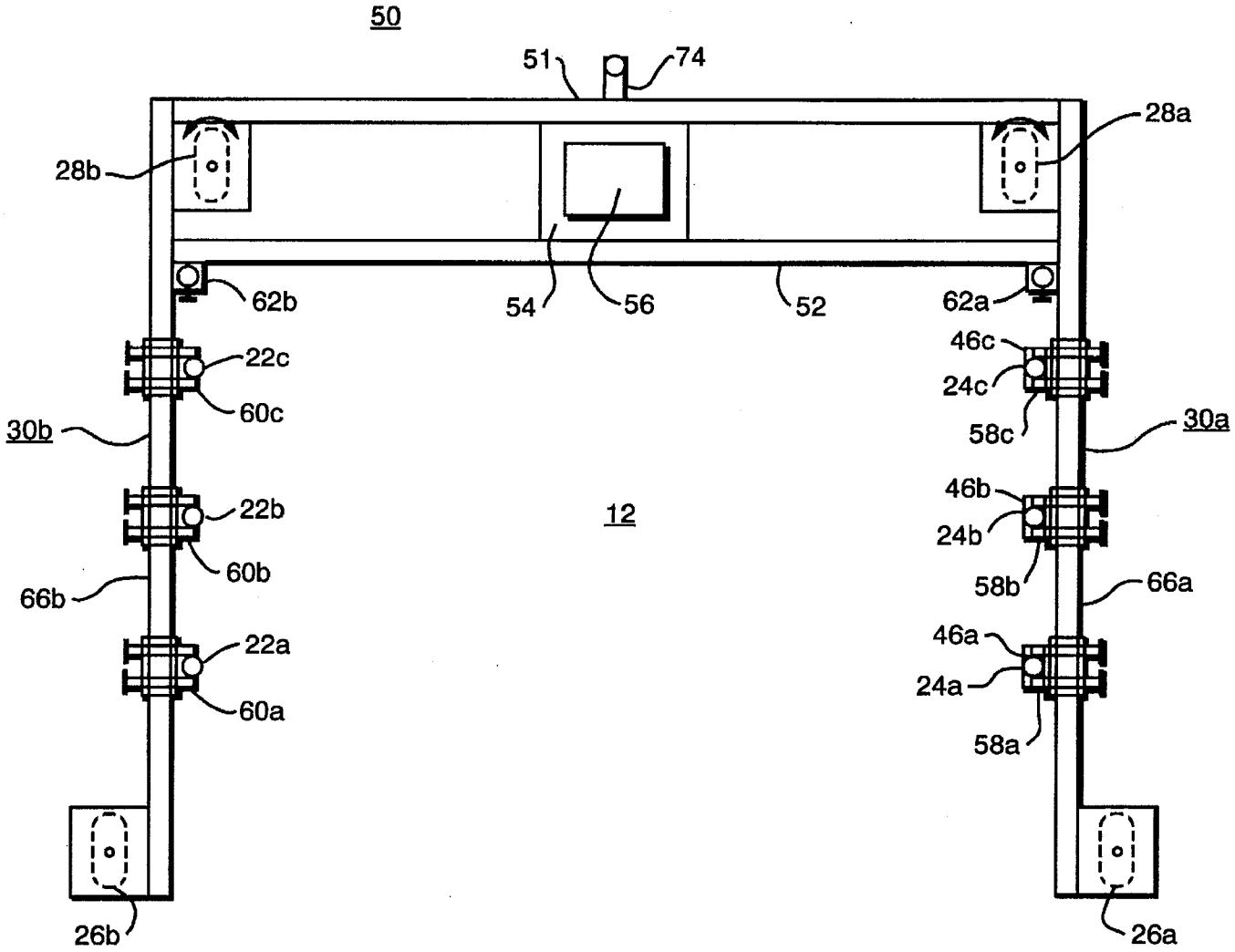
FIG. 4 is a top view of the carrier frame of the portable sports enclosure of the present invention.

Carrier frame 12, FIG. 4, includes a right side 30*a*, a left side 30*b* and back side 50. Fixed or pivotable wheels 26 are provided near the front end of carrier frame 12, with pivotable wheels 28 proximate the back side 50 of carrier frame 12. Alternatively, both wheels 26 and 28 may be pivotable and may include locking means, not shown. The wheels allow portable sports enclosure 10 to be easily maneuvered by a single person while the sports enclosure is in retracted or closed position, and allows for easy extension and retraction.

Carrier frame 12 is fairly symmetrical from side 30*a* to 30*b*. Side 30*a* includes support member locking elements 58 which securely lock the right side 24 of each enclosure support member when the enclosure is retracted. In the preferred embodiment, locking elements 58 securely connect to lock devices or pins 46 on enclosure support member right side 24 using a hole and locking pin relation. Left side 30b also include similar locking elements 60.

Carrier frame 12 is preferably constructed out of lightweight tubular steel having a diameter of 2" and ⅛" gauge walls, and includes support beams 51 and 52 near back side 50. The carrier frame 12 may include platform 54 which allows the mounting of a device 56 inside one end of sports enclosure 10. Device 56 may be any device which can assist the sports activity being performed inside sports enclosure 10, such as a target for pitching or batting, an automatic ball launcher for sports such as tennis or baseball, golf, or a goal net for lacrosse, etc. Carrier frame 12 may also include a trailer hitch 74 to allow the sports enclosure 10 to be towed behind a vehicle. Alternatively, hitch 24 may comprise a handle to facilitate manual transporting and maneuvering of sports enclosure 10 such as by a hand pulled dolly. A steering mechanism may also be included.

Figure 5:
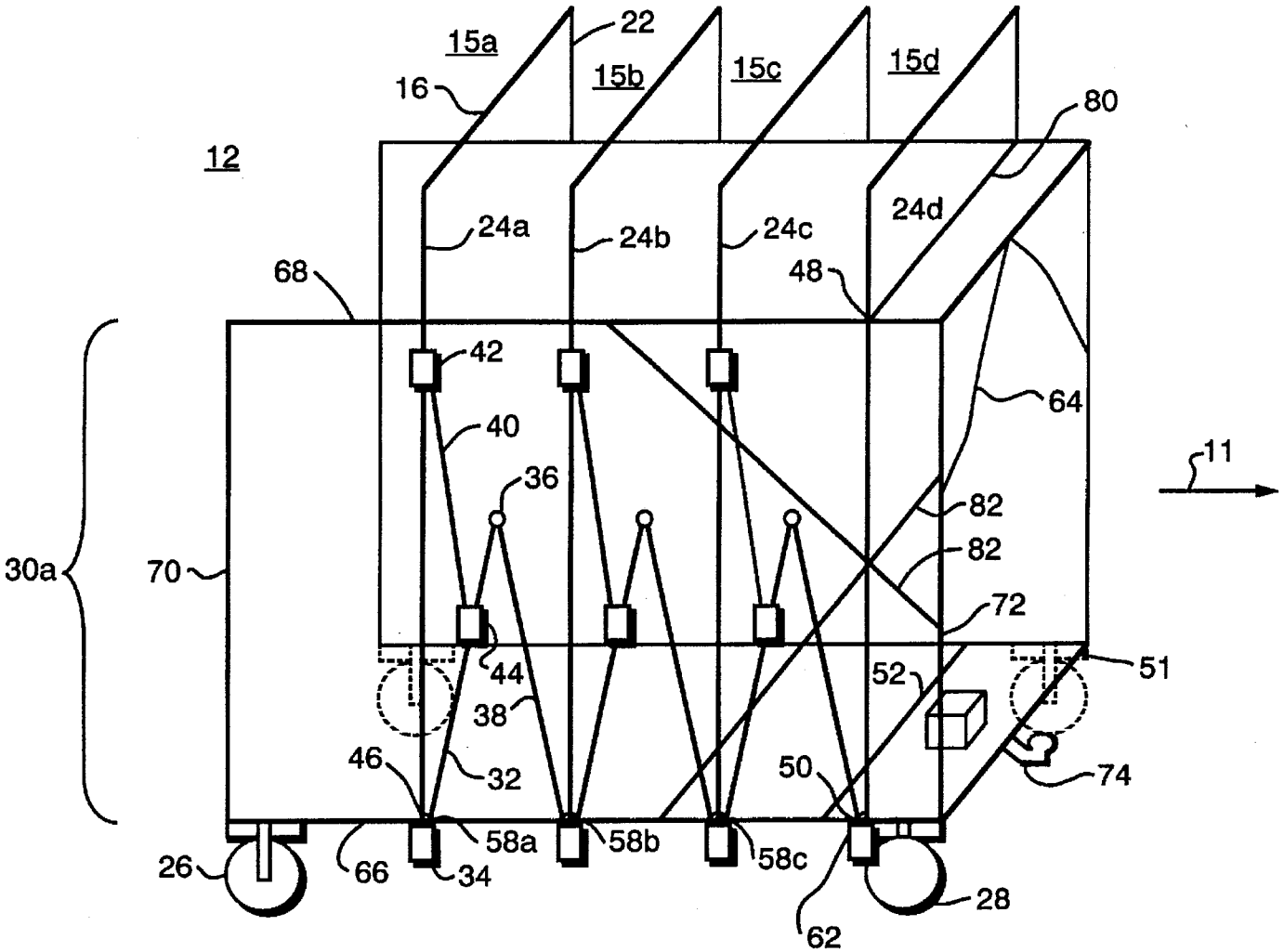
FIG. 5 is a side view of the portable sports enclosure including the carrier frame and foldable frame sections in the closed position.

Side 30*a* of carrier frame 12, FIG. 5 comprises a rectangular shaped structure comprised of an upper member 68, a lower member 66, a front member 70 and a rear member 72. Support wires or bars 82 enhance structural support. End support wires or bars 64 provide end rigidity and support. Side 30*b* (not shown) is a mirror image of side 30*a*.

With the foldable frame sections 14 in retracted and locked position, each enclosure support member 15 is securely locked inside carrier frame 12 on each side. The right side 24 is secured to lower support member 66, with locking member 58*a* securely engaged to locking agent 46*a* on enclosure support member side 24. Each enclosure support member side 24*a*–24*c* is securely locked into place with corresponding locking members 58*a*–58*c*. The left side is similarly secured. As discussed earlier, carrier frame enclosure support member 15*d* is securely connected to side 30*a* of carrier frame 12 by connections 48 and 50 on both sides.

When in the closed and locked positions, hinges 34 of enclosure support member sides 22 and 24 will be raised off the ground by several inches. This provides clearance so sports enclosure 10 can be easily rolled. When a foldable frame section 14 is released, hinges 34 will come down in contact with the ground or floor. As previously mentioned, enclosure support members 15 may be hinged to be allowed to fold in half.

To unfold and open portable sports enclosure 10, a single person need only disconnect locking agent 46 on the enclosure support member right side 24 of the outermost foldable frame section from locking member 58 on lower member 66 of carrier frame 12. The same step is performed on the left side 22. First foldable frame section 14*a* is then free from carrier frame 12 and hinge ends 34 will contact the ground. Carrier frame 12 then is pulled in the direction indicated by arrow 11 which will result in foldable frame section 14*a* unfolding until the interconnection members on both sides are in full contact with the ground. These same steps are performed for each foldable frame sections 14*b* and 14*c*. A single person may perform this operation, thus allowing them to use the sports enclosure for solo practice.

Retracting and closing the sports enclosure 10 is basically the reverse operation of unfolding it. A person or persons would slightly raise the hinges 36 of the last foldable frame section 14*c* off the ground, and then push carrier frame 12 in a direction opposite arrow 11, to cause the foldable frame section 14*c* to fold up. It should then be secured in the carrier frame using locking members 58 and locking agents 46.

In an open position, one foldable frame section 14 measures 10' long by 12' wide and 12' high providing an enclosed playing area of 10×10×10. The sports enclosure, however may be expanded or retracted in size and number of foldable sections 14 to accommodate different requirements for practice enclosures. There is no limit to how large the enclosure may be. It may be created to enclose any number of players and possibly an entire playing field.

Netting 18 can comprise any material which can contain the sporting projectiles including balls, discuss, boomerangs, Frisbees, pucks, shot-puts and hammers. Fairly coarse nylon 19 netting having an opening of 1 ¼" square may be used for sports with large balls such as soccer or football and even baseball, while finer netting having a mesh opening of ¼" may be employed for smaller balls such as golf balls. Even finer netting may be used to prevent insects from bothering the persons inside the enclosure, or even a non-permeable material such as transparent plastic or canvas may be used to provide a weather tight enclosure.

The netting is attached to various points along enclosure support members 15 with the netting provided inside the frame, if desired, to prevent a ball from striking support piece and rebounding back towards the player, and to prevent the netting 18 from interfering with the mechanisms in each foldable frame section 14. The netting may remain attached while the portable sports enclosure is closed- In the preferred embodiment, net 18 may be raised and lowered using a rope 134, FIG. 11*a* which passes through eyelets 131. The net 18 is attached to eye hooks 132, which hold the upright net approximately one foot away from a frame 15. This prevents a fast moving ball from contacting a frame element and bouncing back to harm the users inside the structure.

Figure 11B:
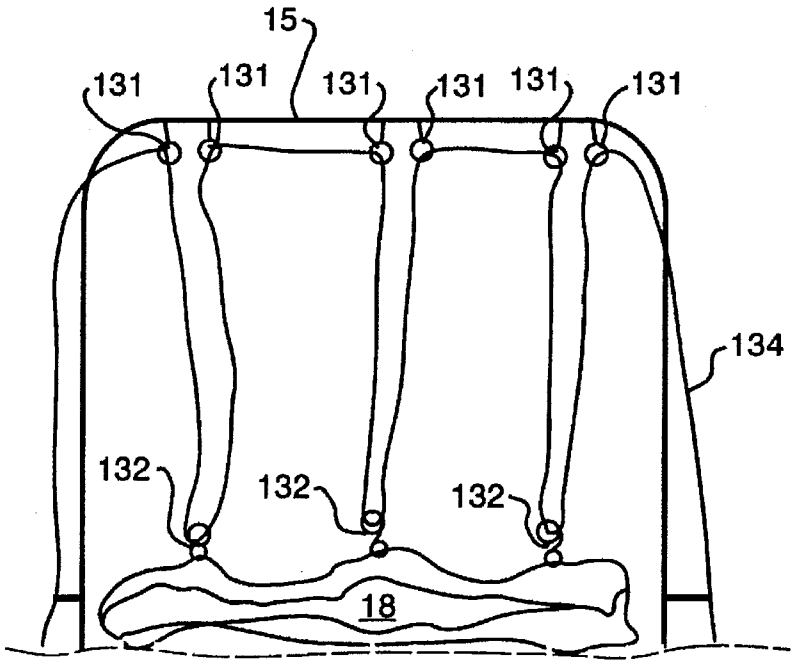
FIG. 11B is the net attachment system, with the net in a down position.
Figure 11A:
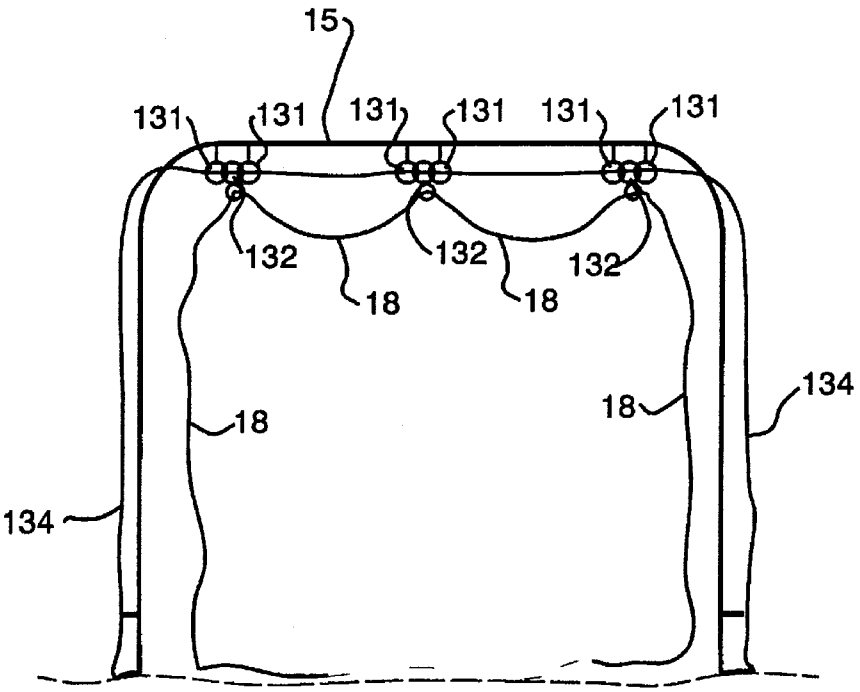
FIG. 11A is a front view showing an attachment system for netting material for raising the net on an enclosure support member.

To remove the net 18, rope 134 FIG. 11*b* is lowered thereby lowering the eye hooks 132 holding the net 18 down to ground level where the net may be removed and stored away until needed. Alternatively, the netting may be draped over the enclosure support members 15.

The portable sports enclosure 10 is a self standing structure which does not interfere with the playing surface on which the participants are using. There are no cross bars on the ground inside the enclosed structure. The carrier frame 12 allows easy deployment and retraction of the entire unit thereby allowing a single person to open, use and close the structure. Once closed, the sports enclosure 10 occupies a small area and allows easy storage in a corner of a gym, storage shed or garage. Once open, the sports enclosure 10 provides a large area for practice or games, and provides protection from the sports equipment and projectiles from leaving the sports enclosure as well as protecting the occupant of the sports enclosure from projectiles from other nearby sports.

Figure 6A:
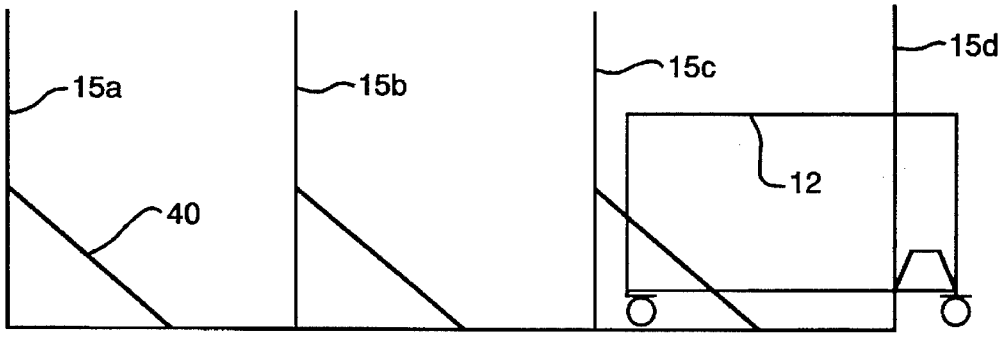
FIG. 6A is a side view of the portable sports enclosure according to one embodiment of the invention.
Figure 6B:
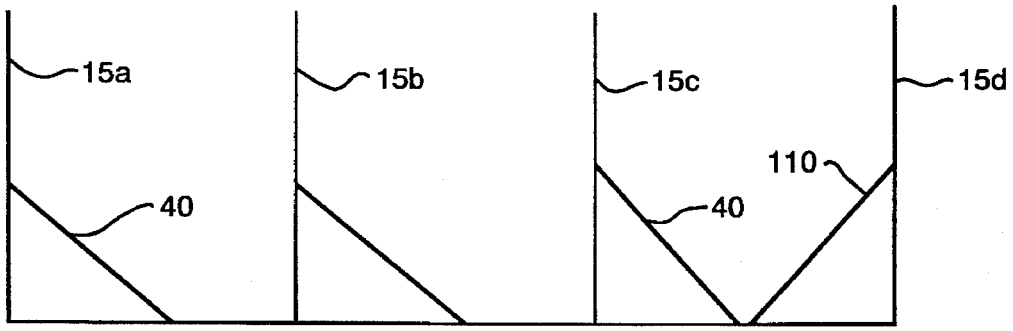
FIG. 6B is another embodiment of the sports enclosure which does not require a carrier frame for support.

In another embodiment of the present invention, carrier frame 12 is not required. In that case, upright support member **15*b*, FIG. 6B contains a separate enclosure support member stabilizer 110, similar to the enclosure support member stabilizers 40**. In such an embodiment, no carrier frame is necessary to support the free standing structure.

Figure 6C:
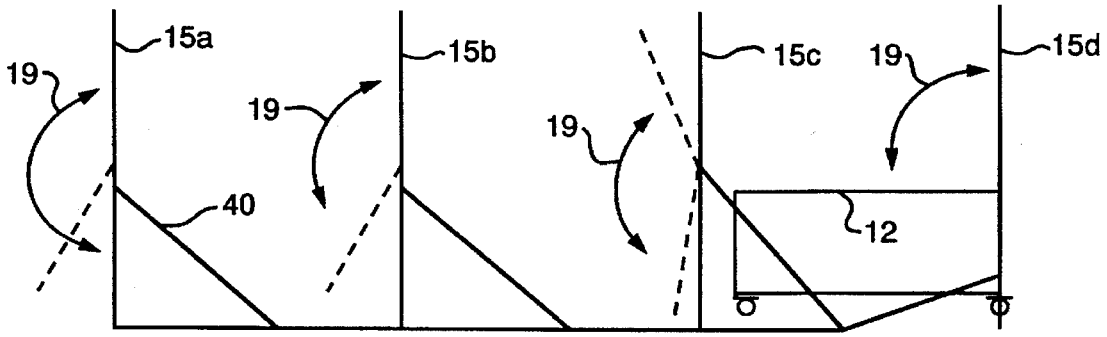
FIG. 6C is a side view of another embodiment of the invention with a carrier frame that is half as high and enclosure support members that fold in half, allowing the portable sports enclosure to more easily fit through a doorway.
Figure 7A:
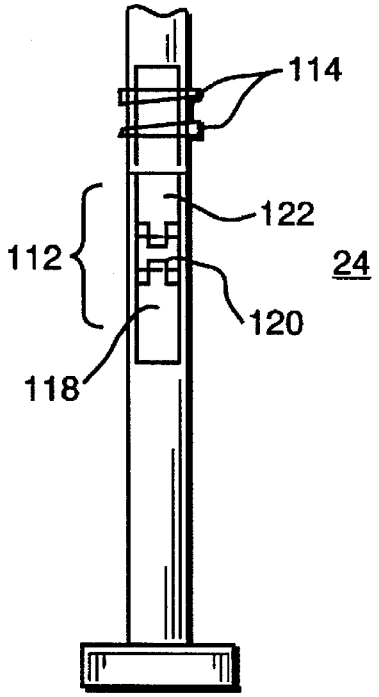
FIG. 7A shows a folding mechanism for allowing an enclosure support member to be folded.
Figure 7B:
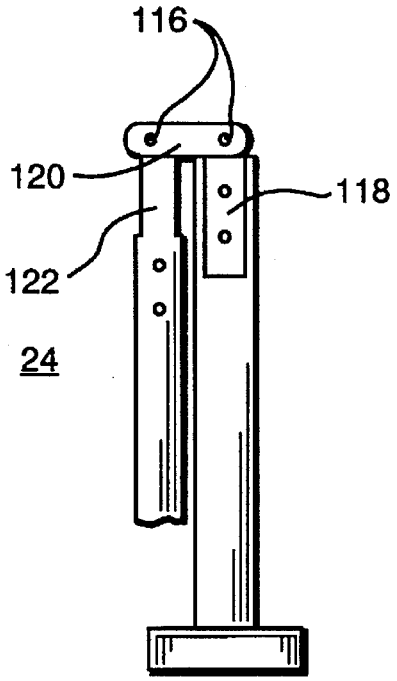
FIG. 7B is the folding mechanism in folded position.

For an embodiment where the enclosure support members 15 fold down, FIG. 6C, a double hinged folding mechanism such as 112, FIG. 7A is provided. To fold a side bar 22, 24, bolts 114 are removed, and the upper half of side bar 24 is lifted until smaller diameter pipe 122 is free from inside the lower half of side bar 22, 24. Hinges 116 and connector 120 allow the upper half of side bar 22, 24 to fold down, FIG. 7B, thereby decreasing the height of the portable sports enclosure 10 by approximately one-half.

Figure 8:
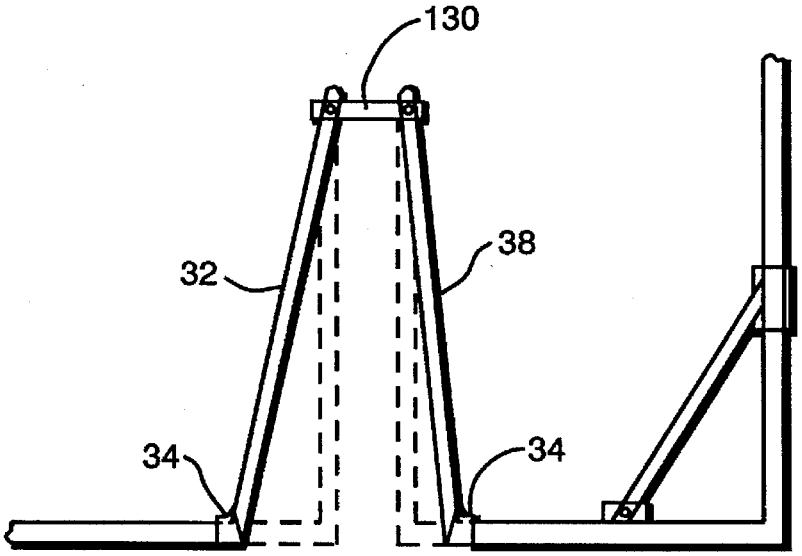
FIG. 8 is another embodiment of a foldable frame section.
Figure 9:
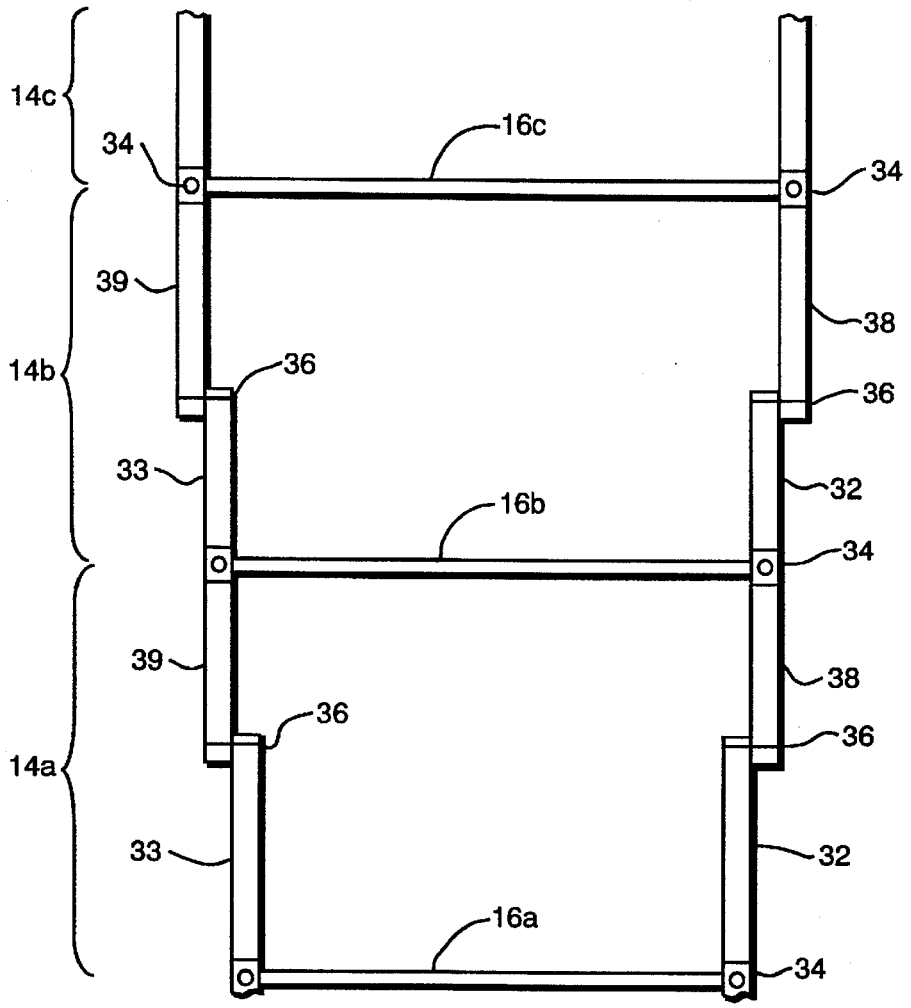
FIG. 9 is a top view of yet another embodiment of the foldable frame sections of a portable sport enclosure which fold inside each other.
Figure 10:
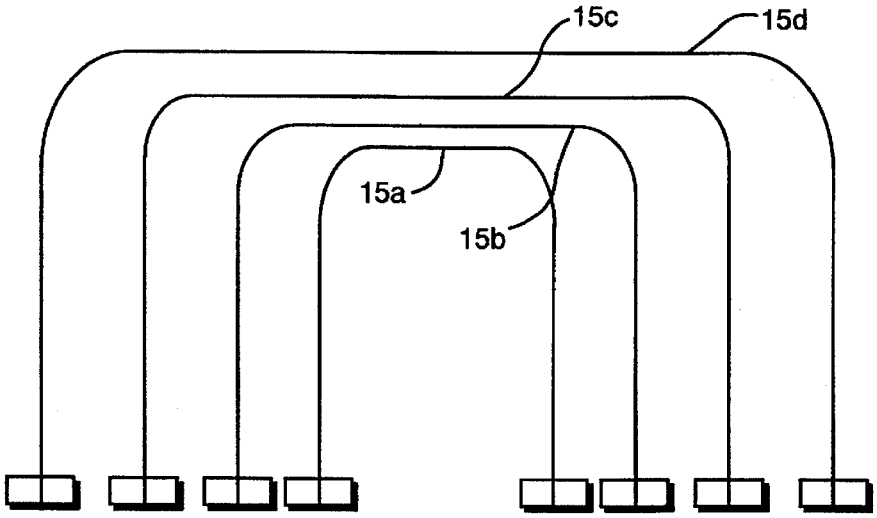
FIG. 10 is a front view of the embodiment of FIG. 9 of the sports enclosure which may be folded flat, showing the nesting of the enclosure support members.

In still another embodiment of the present invention, the foldable frame sections are designed to fold and store concentrically within each other, FIG. 9. The first foldable frame section **14*a* is less wide than the next section 14*b*. When each foldable frame section is folded, it may fold so that support bar 16*a* fold underneath bar 16*b*, as shown in FIG. 10. This allows the portable sports enclosure to fold into a flat plane. To help facilitate this, interconnection members 32 and 38, FIG. 8 may be connected by a parallel hinge 130 instead of the standard hinge 36, FIG. 2. This parallel hinge 130 allows interconnection member 32 to fold closed next to interconnection member 38, allowing the embodiment shown in FIG. 9** to fold flat.

Modifications and substitutions by one of ordinary skill in the art are considered to be within the scope of the present invention which is not to be limited except by the claims which follow.

What is claimed is:

1. A portable, self-standing sports enclosure comprising: at least one foldable frame section, including:

at least a first enclosure support member including a first side having a first side end region, and a second side having a second side end region;

at least four enclosure support member interconnection members, each of said at least four enclosure support member interconnection members having first and second ends, said first end of a first enclosure support member interconnection member pivotably coupled to said first end region of said at least a first enclosure support member, said second end of said first enclosure support member interconnection member pivotably coupled to said first end of a second enclosure support member interconnection member, said first end of a third enclosure support member interconnection member pivotably coupled to said second end region of said at least a first enclosure support member, and said second end of said third enclosure support member interconnection member pivotably coupled to said first end of a fourth enclosure support member interconnection member; and at least first and second enclosure support member stabilizers, each of said at least first and second enclosure support member stabilizers having first and second ends, said first end of said first enclosure support member stabilizer slidably coupled to said first side of said at least a first enclosure support member, and said second end of said first enclosure support member stabilizer pivotably coupled to said first enclosure support member interconnection member proximate a point between said first and second ends of said first enclosure support member interconnection member and said first end of said second enclosure support member stabilizer slidably coupled to a second side of said at least first enclosure support member, and said second end of said second enclosure support member stabilizer pivotably coupled to said third enclosure support member interconnection member proximate a point between said first and second ends of said third enclosure support member interconnection member.

2. The portable, self-standing sports enclosure of claim 1, further including a plurality of interconnected foldable frame sections, wherein a second end of a second enclosure support member interconnection member of a second one of said plurality of foldable frame sections is pivotably coupled to said first end region of said at least a first enclosure support member of said at least one foldable frame section; and a second end of a fourth enclosure support member interconnection member of said second one of said plurality of foldable frame sections is pivotably coupled to said second end region of said at least a first enclosure support member of said at least one foldable frame section.

3. The portable, self-standing sports enclosure of claim 2, wherein said plurality of interconnected foldable frame sections expand to form a sports enclosure of generally 60 feet in length.

4. The portable, self-standing sports enclosure of claim 2 wherein said plurality of interconnected foldable frame sections are consecutively generally smaller in a width dimension, allowing said plurality of interconnected foldable frame sections to fold within each other, allowing said portable self-standing sports enclosure to fold generally flat within a width dimension of one foldable frame section.

5. The portable, self standing sports enclosure of claim 1 further including a carrier frame, wherein said second end of said second enclosure support member interconnection member is pivotably coupled to said carrier frame, and said second end of said fourth enclosure support member interconnection member is pivotably coupled to said carrier frame.

6. The portable, self-standing sports enclosure of claim 5, wherein said carrier frame includes wheels.

7. The portable, self-standing sports enclosure of claim 5, wherein said carrier frame further includes an enclosure support member coupled to said carrier frame, and including a first and second end region, wherein said second end of said second enclosure support member interconnection member of said at least one foldable frame section is pivotably coupled to said first end region of said enclosure support member coupled to said carrier frame; and said second end of said fourth enclosure support member interconnection member of said at least one foldable frame section is pivotably coupled to said second end region of said enclosure support member coupled to said carrier frame.

8. The portable, self-standing sports enclosure of claim 5, wherein said carrier frame further includes first and second locking mechanism for locking said foldable frame section into said carrier frame, said first locking mechanism connected to said first side of said at least one enclosure support member proximate said first end region, and said second locking mechanism connected to said second side of said at least one enclosure support member proximate said second end region.

9. The portable, self-standing sports enclosure of claim 3, wherein said at least one foldable frame section retracts completely within said carrier frame.

10. The portable, self-standing sports enclosure of claim 5, wherein said carrier frame further includes a platform member to support a sports device.

11. The portable, self-standing sports enclosure of claim 10 wherein said sports device includes a ball launching machine.

12. The portable, self-standing sports enclosure of claim 11, wherein said ball includes a baseball.

13. The portable, self-standing sports enclosure of claim 11 wherein said ball includes a tennis ball.

14. The portable, self-standing sports enclosure of claim 5, wherein said carrier frame further includes a towing device.

15. The portable, self-standing sports enclosure of claim 1, further including an enclosure netting member attached to said at least one foldable frame section.

16. The portable, self-standing sports enclosure of claim 15, wherein said enclosure netting member is nylon.

17. The portable, self standing sports enclosure of claim 15 wherein said netting member is disposed proximate an exterior region of said at least one foldable frame section.

18. The portable, self standing sports enclosure of claim 15 where said netting member is disposed proximate an interior region of said at least one foldable frame section.

19. The portable, self-standing sports enclosure of claim 1, wherein said enclosure support member is shaped as an inverted "U".

20. The portable, self-standing sports enclosure of claim 1 wherein said first and second side of said at least a first enclosure support member include a pivotal hinge member for allowing said at least a first enclosure support member to fold down generally in half, for reducing a height dimension of said at least a first enclosure support member.

* * * * *